US005772220A

United States Patent [19]

Gaster

[11] Patent Number: 5,772,220

[45] Date of Patent: Jun. 30, 1998

[54] IN-LINE SKATE CONVERSION APPARATUS

[76] Inventor: Richard S. Gaster, 2702 Motor Ave., Los Angeles, Calif. 90064

[21] Appl. No.: 480,011

[22] Filed: Jun. 7, 1995

[51] Int. Cl.[6] ..... A63C 17/04; A63C 17/20

[52] U.S. Cl. ..... 280/7.1; 280/11.22; 280/825; 36/115

[58] Field of Search ..... 280/7.1, 7.11, 280/11.19, 11.2, 11.21, 11.22, 11.26, 11.27, 809, 811, 825, 7.12; 36/115, 116

[56] References Cited

U.S. PATENT DOCUMENTS

| | | | |
|---|---|---|---|
| 199,664 | 1/1878 | Robinson | 280/11.2 |
| 988,533 | 4/1911 | Zverina | 280/11.27 |
| 2,035,897 | 3/1936 | Kosanovich | 280/7.13 |
| 2,148,687 | 2/1939 | English | 280/7.13 |
| 4,273,345 | 6/1981 | Ben-Dor et al. | 280/11.2 |
| 4,333,249 | 6/1982 | Schaefer | 280/11.19 |
| 4,526,389 | 7/1985 | Chase | 280/11.21 |
| 5,183,292 | 2/1993 | Ragin, III | 280/825 |
| 5,239,941 | 8/1993 | Chibi | 280/11.2 |
| 5,388,844 | 2/1995 | Pellegrini, Jr. et al. | 280/11.2 |
| 5,551,711 | 9/1996 | Mangelsdorf | 280/11.2 |
| 5,586,777 | 12/1996 | Wolf | 280/11.22 |

*Primary Examiner*—Brian L. Johnson
*Assistant Examiner*—Min Yu
*Attorney, Agent, or Firm*—Graham & James LLP

[57] ABSTRACT

At least one walking member is adaptively coupled to an in-line skate to enable the walking member to be extended and retracted to and from the skate, thereby enabling the in-line skate to be converted from a rolling skate to a walking shoe. Two walking members can be provided on alternative sides of the in-line skate wheels to provide a more stable platform for the wearer of the in-line skate. The walking members do not detract from the aerodynamic and functional performance of the in-line skate, and can be manufactured together with the skate or, alternatively, can be added to the skate after purchase.

18 Claims, 4 Drawing Sheets

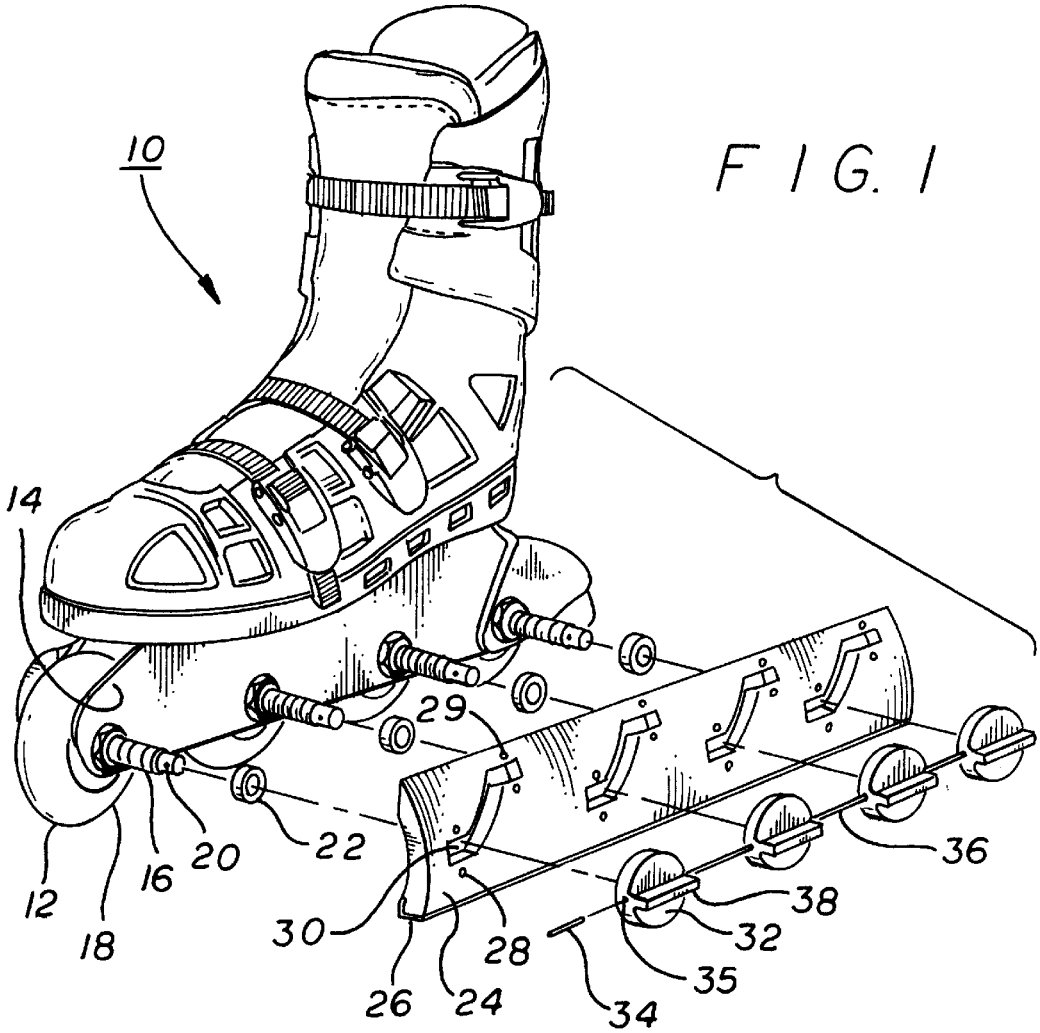
FIG. 1
FIG. 2
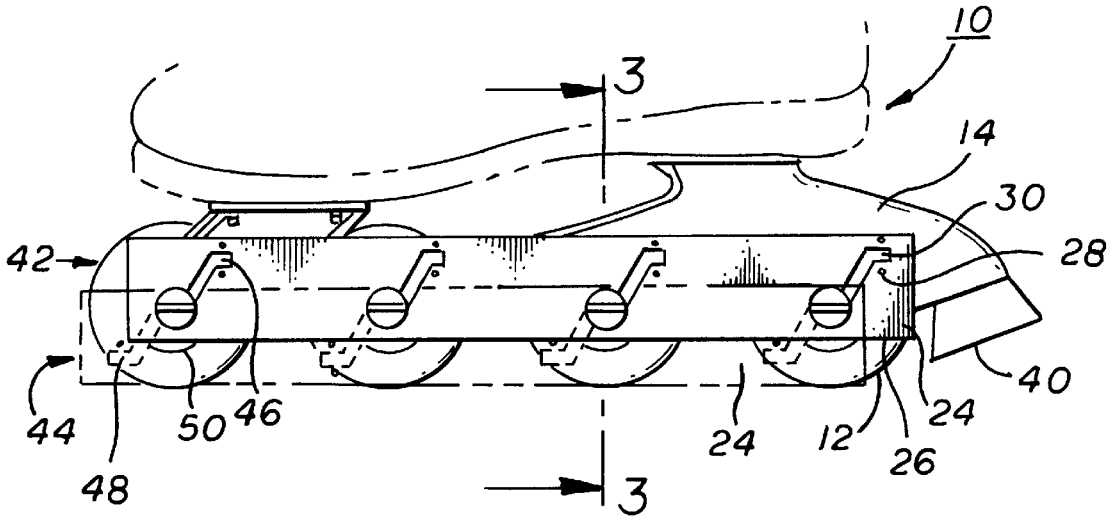

IN-LINE SKATE CONVERSION APPARATUS

FIELD OF THE INVENTION

The present invention is directed to an in-line skate conversion apparatus. More particularly, the present invention is directed to an apparatus for enabling and the wearer of an in-line skate to essentially disable the wheels of the skate, thus enabling the wearer to walk in the skate without fear of falling because of slipping due to the wheels of the skate.

BACKGROUND OF THE INVENTION

In-line skating has exploded in popularity over the last several years. Indeed, in-line skates have replaced roller skates in popularity. One of the reasons for the surge in popularity of in-line skating may be due to the wide variety of equipment available and the lack of a requirement that in-line skating be performed in any particular place. That is, unlike ice skating which requires an individual to go to an ice rink, or roller skating which has traditionally be enjoyed in roller skating rinks, in-line skates are specifically manufactured for use in the outdoors, provided there is a suitable hard surface to skate on. Furthermore, due to the relatively low cost of beginning participation in the sport—which typically requires the purchase of the skates and optional padding for elbows, knees and wrists—in-line skating is economically feasible for most people. As in-line skating has developed, several problems have arisen.

In particular, novice in-line skaters often time have difficulty braking or otherwise slowing themselves down after building up speed. One of the difficulties with braking in in-line skates is the requirements that pressure be placed on a brake pad located substantially rearward of the heel of the wearer. Many skaters have complained that the application of pressure in a downward fashion at the heel by raising the toe is an unnatural motion which requires coordination. Many skaters often time lose balance and fall when attempting to brake in this fashion. To solve the problem with braking in in-line skates, numerous individuals have attempted to offer different braking solutions. For example, U.S. Pat. No. 5,320,367 to Landis which issued on Jun. 14, 1994, disclosed a braking apparatus which utilizes a hand-held brake control for causing the application of rubber brake pads to the wheels of the in-line skate to slow the wearer down. In addition, major in-line skate manufacturers such as Rollerblade have proposed alternative braking mechanisms to assist the wearer in the braking operation.

After the wearer has stopped, however, the wearer must still be able to maneuver on the in-line skates. This has lead to another problem in that once an in-line skater has stopped, in order to move in any direction, the wearer of the skates must roll to the next location. This can often make it quite awkward for a novice in-line skater to, for example, stop at an outdoor snack bar to have lunch. After ordering the food from the window, the skater must carry the food from the window to, for example, an nearby table. The act of carrying the food from the window to the nearby table can represent a terrifying journey for a novice in-line skater. Indeed, the inventor of the instant application had food splattered on him because his mother was unable to stop on her in-line skates while she was carrying food from an outdoor snack bar to the table.

In addition to the above-described '367 patent, U.S. Pat. No. 4,273,345 to Ben-Dor et al. provides a friction plate for the wearer of the skate to drag along the ground to stop the movement of the skate.

U.S. Pat. No. 3,351,353 to D. M. Weitzner discloses a pair of retractable roller and ice skates for shoes. As seen in FIGS. 10 and 13 of the '353 patent, the shoe can be taken apart so that a plate 50 is removed from its channel, inverted, and then reinserted into the channel 40 above the roller assemblies. The plate is thus stored out of the way in the channel and at the same time serves as a spacer and bearing member holding the roller assembly 70 in a stable position in the sole of the shoe, thus enabling the shoe to serve as a roller skate. While the device enables a shoe to be worn as a roller skate, it requires the shoe to be disassembled and reassembled prior to wearing the roller portion of the shoe.

Similarly, U.S. Pat. No. 3,979,842 to Texidor discloses an athletic shoe exerciser which retains rollers when they are not being used in a lower portion of the exerciser. Specifically, as seen in FIG. 2, the roller skates are folded up into the base 14 of the shoe when not in use. Other modifications are sports shoes are also known. For example, U.S. Pat. No. 4,114,295 to Schaefer discloses a convertible sports shoe which may be converted from a roller skate to an ice skate. Similarly, U.S. Pat. No. 3,387,852 discloses roller skates which can be removed from the bottom of the shoe 20. U.S. Pat. No. 5,224,718 to Gertler discloses a foot transport device which can be fastened to a standard walking shoe. Finally, U.S. Pat. No. 4,988,122 discloses a combination roller skate and ice skate which includes a boot which can have a roller portion or an ice skate portion attached thereto.

The inventor has found a need for a conversion apparatus which would enable the wearer of standard in-line skates to walk on the skates without activating the wheels thereof. Furthermore, such a device would have to be cost effective, rugged and simple to use while not requiring the wearer to take the skates off their feet. Furthermore, such a device must be usable with a wide variety of in-line skates, including in-line skates having 3, 4 or more wheels. The device must be aerodynamically acceptable to advanced in-line skaters as well as practical for novices to utilize.

SUMMARY OF THE INVENTION

The present invention solves the above and other problems associated with the prior art while providing for an economically efficient apparatus for converting a standard in-line skate to a walking shoe without sacrificing the performance characteristics of the in-line skate.

More particularly, the present invention provides for a cost effective solution to the problem of converting an in-line skate to a walking shoe by providing at least one walking member which extends from a wheel support plate in a downward direction to a position equal to or beyond the range of the wheels. When the walking member is extended, the in-line skate is converted to a relatively stable walking platform to enable the wearer to maneuver in relative safety. Thus, for example, with the walking members in the down position, the wearer would be able to walk from an outdoor snack counter without having to worry about the ability to stop once she arrived at the table. In this fashion, she could avoid spilling food and drinks on her children by maintaining control at all times.

Similarly, the present invention will enable the wearer of in-line skates to skate from, for example, from their home to a place of business such as a store, and then convert the skate to a walking shoe to allow the individual to enter the premises. After the user has conducted their business in the premises, they can leave the business, reconvert the skates to standard in-line skates by raising the walking members, and then continue on their way using the in-line skates in the normal fashion.

The apparatus of the present invention provides for the conversion of in-line skates to walking shoes while maintaining the aerodynamic and performance qualities of the in-line skates such that the device will be acceptable to both advanced as well as novice in-line skaters. Furthermore, the device of the present invention may be adapted to presently existing in-line skates through the use of simple conversion hardware. It is economical to install and cost effective to manufacture.

The above and other embodiments and features of the present invention will be better understood through a reading of the detailed description of the present invention when taken in conjunction with the drawings. It should be understood that the following description and drawings are in no way intended to limit the present invention which is best defined by the claims appended hereto.

BRIEF DESCRIPTION OF THE DRAWINGS

FIG. 1 is an exploded perspective view of an in-line skate incorporating one embodiment of the present invention.

FIG. 2 is a partial side view of the in-line skate seen in FIG. 1 illustrating the operation of one embodiment of the present invention.

DETAILED DESCRIPTION OF THE PREFERRED EMBODIMENTS

Figure 3:
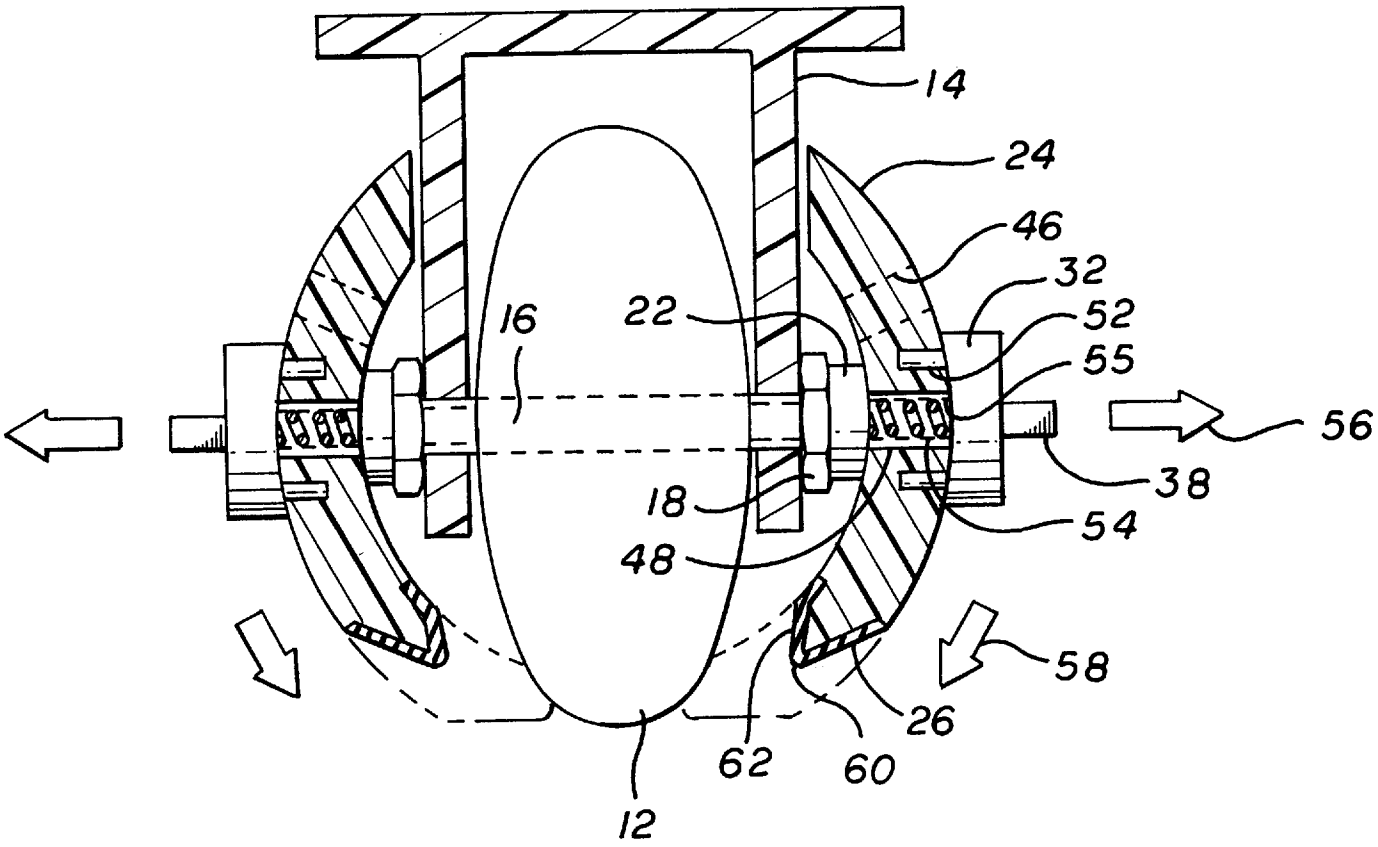
FIG. 3 is a cross-sectional view of a portion of the in-line skate of FIG. 2 taken along the lines 3—3 of FIG. 2.

FIGS. 1–6 illustrate the preferred embodiments of the present invention. In the following discussion of the presently preferred embodiments, like reference numerals refer to like elements. Further, the following discussion is not to be considered in a limiting sense. Rather, while the following discussion taken in conjunction with the drawings illustrate the presently preferred embodiments of the present invention, the invention is in no way limited to the embodiments described below and shown in the drawings. It is to be understood that numerous modifications, additions and/or substitutions can be made to the preferred embodiments without departing from the spirit and scope of the present invention.

FIGS. 1–3 illustrate a first preferred embodiment of the present invention. An in-line skating boot 10 in accordance with the present invention incorporates a plurality of wheels 12 which are connected to the boot 10 through a pair of wheel support members or plates 14. A plurality of bolts 16 connect the wheels support plates 14, which are connected to the underside of the boot 10, to the wheels 12. A plurality of nuts 18 are used to fasten the bolts 16 in place on the wheel support plates 14. The bolts 16 are threaded at appropriate locations to allow the nuts 18 to be secured thereto. Further, one skilled in the art will recognize that washers may be placed between the nuts 18 and the wheel support plates 14. Likewise, washers may also be used between the wheel support plates 14 and the wheels 12. At this point, it should be understood that while the following description and references to the drawings will be made primarily to a single side of the in-line skating boot 10 incorporating the present invention (e.g. as seen in FIG. 1), the present invention can incorporate similar elements on each side of the wheels 12 as seen in, for example, FIG. 3.

The bolts 16 illustrated in FIG. 1 incorporate a tubular receptacle 20 at locations substantially adjacent to respective ends thereof. Referring more specifically to FIGS. 1 and 3, it is seen that a spacer 22 is fitted over the bolt 16 and rests substantially adjacent to the nut 18. The spacers 22 serve to space a pair of curved walking members 24 from respective side surfaces of the wheel support plates 14. The walking members 24 are formed in an arched fashion and incorporate a rubber strip 26 along a lower ground-facing surface thereof. The walking members 24 incorporate a pair of lower locking holes 28 and pair of upper locking holes 29 at respective ends of a plurality of slide slots 30 through which extends the corresponding plurality of bolts 16. A corresponding number of walking member control knobs 32 are disposed on respective ends of each of the plurality of bolts 16. A knob securing pin 34 is inserted into holes formed in a side surface of the walking member control knobs 32 and is received in the receptacles 20 disposed at respective ends of the bolts 16. The walking member control knobs 32 are provided with a finger grip ridge 38. A connecting rod 36 may be provided to connect each of the respective walking member control knobs 32 so that such knobs may be operated in a simultaneous fashion as described in more detail below.

The general operation of the present invention will be described with reference to FIG. 2. The typical in-line skate boot 10 is provided with a braking pad 40 disposed substantially rearward of the heel of the boot 10 and is attached to the wheel support plates 14. As seen in the FIGURE, the walking member 24 is shown illustrated in two positions: an up position 42 and a down position 44. In order to move the walking member 24 from the up position 42 to the down position 44, the bolts 16 which extend through the walking member 24 by passing through the slide slots 30 must be positionable in an upper bolt rest position 46 or a lower bolt rest position 48. A transitional slot 50 connects the upper bolt rest position 46 with the lower bolt rest position 48. Thus, referring to FIG. 2 specifically, in order for the walking member 24 to be moved from the up position 42 to the down position 44 (the walking member 24 is illustrated by dashed lines in the down position 44), the walking member 24 which is positioned such that the bolt 16, which is positioned at the lower bolt rest position 48, must be changed from the lower bolt rest position 48 via the transitional slot 50 and to the upper bolt rest position 46. Thus, when the bolts 16 are positioned in the upper bolt rest positions 46, the walking member 24 is disposed in the down position 44. Similarly, when the bolts 16 are positioned in the lower bolt rest positions 48, the walking member 24 is disposed in the up position 42. When the walking member 24 is disposed in the down position 44, the rubber strip 26 is preferably disposed at a position substantially level with the lowest position on the wheels 12. Of course the down position of the rubber strip 26 may be determined based on the distance between positions 46, 48.

Referring in more detail to FIG. 3, the transition of the walking member from the up position 42 to the down position 44 as illustrated in more detail. Specifically, it is seen that the walking member control knobs 32 have a pair of locking pins 52 which protrude from an inner surface of the walking member control knobs 32. The locking pins 52 are preferably made of steel or suitably hard materials such as ceramic, in order to support the weight of the wearer. The locking pins 52 are received in the respective lower and upper locking holes 28, 29 seen in FIG. 1. By receiving the locking pins 52 in the respective locking holes 28, 29, the bolts 16 which attach to the walking member control knobs 32 are held in the respective upper and lower bolt rest positions 46, 48. A spring 54 is mounted inside of the bolt 16 and is used to bias the walking member control knobs 32 against the walking members 24. A spring channel 55 is provided within the bolts 16 to contain the spring 54. The spring 54 is preferably of sufficient strength to properly bias the walking member control knobs 32 while still allowing the wearer to be able to overcome the force of the spring 54 to move the walking member control knobs 32 in the direction of the directional arrows 56.

In operation, the control knob 32 is pulled by the wearer in the direction of the outward directional arrow 56 and the walking member 24 is moved by the wearer in the direction of the downward directional arrow 58. The transitional movement of the walking member 24 in the direction of the downward directional arrow 58 is achieved by the movement of walking members 24 relative to the bolts 16 in the transitional slots 50 between the lower bolt rest position 48 and the upper bolt rest position 46. It should be noted that the downward directional arrow 58 is additionally angled in an inward fashion. The arched movement of the walking member 24 as the position of the bolt 16 is changed from the lower bolt rest position 48 to the upper bolt rest position 46 is achieved due to the arcuate structure of the walking member 24. Specifically, the inward arc formation of the walking member 24 moves relative to spacer 22 which causes the ground-side surface 60 of the rubber strip 26 to move inward toward the wheels 12. As can be seen in FIG. 3, the rubber strip 26 is disposed along each side of the tip of the walking member 24. In this fashion, the rubber strip 26 includes a wheel-side surface 62. When the walking member 24 is disposed in the down position 44, seen in FIG. 2, the wheelside surface 62 of the rubber strip 26 is disposed substantially adjacent to the wheel 12. In this fashion, when the walking member 24 is in the down position 44, the wheels 12 are prevented from turning due to the frictional contact between the wheel-side surface 62 of the rubber strip 26 and the wheels 12. Of course, the rubber strip 26 may be provided with a tread or knobby bottom surface to assist in traction. The rubber strip 26 is also optional, or could be formed of a different material.

Referring back to FIG. 1, the walking member control knobs 32 may be pulled in an outward direction identified by the outward directional arrow 56, and turned to the prevent the locking pins 52 from remaining engaged in the respective locking holes 28, 29 due to the biasing force of the spring 54. After all of the knobs 32 have been pulled and turned to disengage the respective pins 52, walking member 24 may be slid between the up and down positions 42, 44, as seen in FIG. 2. Alternatively, a connecting rod 36 may be provided between each of the walking member control knobs 32. In this fashion, by pulling on the connecting rod 36, the wearer of the shoe may operate all of the walking member control knobs 32 located on a side of the in-line skate boot 10 simultaneously.

Figure 4:
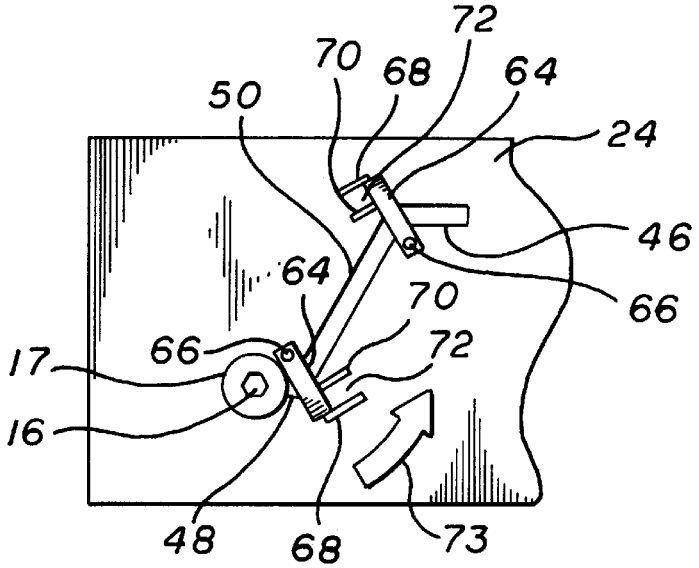
FIG. 4 is a partial side view of an alternative locking arrangement for use with the present invention.

Referring to FIG. 4, an alternative embodiment for a locking mechanism is shown. Specifically, in FIG. 4 the bolts 16 is provided with an optional rounded head 17. A locking arm 64 is disposed at the upper and lower bolt rest positions 46, 48. A pair of channels 68, 70 define a locking tongue 72 which is preferably formed to incline upwardly from the side of the walking member 24. The locking tongue 72 is formed integral with the walking member 24 and is moveable in a direction normal to the plane of FIG. 4. The locking arm 64 pivots in a circular fashion about a pivot pin 66.

In operation, the wearer simply pushes inward on the locking tongue 72 which allows the locking arm 64 to pivot about the pivot pin 66 in a circular fashion, thus releasing the bolt 16 and optional rounded head 17 from the upper or lower bolt rest positions 46, 48. Specifically, to move the walking member 24 such that the bolt 16 and optional rounded head 17 are changed from the lower bolt rest position 48 to the upper bolt rest position 46 seen in FIG. 4, the wearer would push down on the lower locking tongue 72, and pivot the locking arm 64 in the direction of directional arrow 73 about the pivot pin 66. This would allow the position of the bolt 16 and optional rounded head 17 to be changed to the transitional slot 50 and then up towards the upper bolt rest position 46. The upper locking arm 64 can remain in the position illustrated in FIG. 4 and when the bolt 16 and optional rounded head 17 reach the upper location, the upper locking arm 64 would pivot in a position opposite to the directional arrow 73 in circular fashion, thus, allowing the bolt 16 and optional rounded head 17 to enter the upper bolt rest position 46. The upper locking arm 64 would travel in a circular, clockwise fashion and slide over the upper locking tongue 72 (pushing the upper locking tongue in a downward fashion). When the upper locking arm 64 traveled past the upper locking tongue 72, the upper locking tongue 72 is biased so as to spring outward thus holding the upper locking arm 64 in the position illustrated in FIG. 4.

Figure 5:
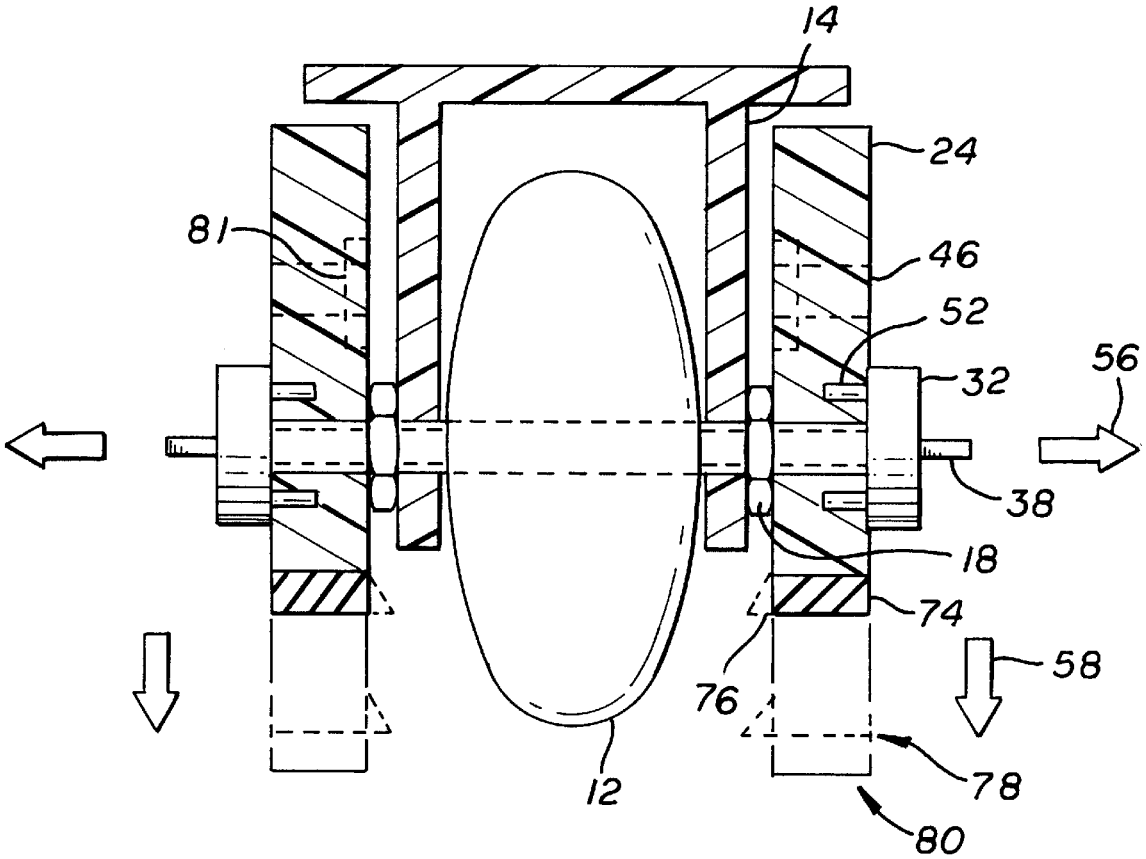
FIG. 5 is a partial cross-sectional view of another embodiment the present invention taken along the lines 3—3 of FIG. 2.

Referring to FIG. 5, FIG. 5 illustrates an alternative embodiment of the present invention in which the walking members are formed of straight vertical members as opposed to the arcuate members 24 illustrated in FIGS. 1–3. The embodiment illustrated in FIG. 5 works in a substantially similar fashion to that illustrated in FIGS. 1–3 with the exception of the ability to eliminate the spacer 22. In addition, the walking members 24 illustrated in FIG. 5 are provided with an alternative rubber strip 74 disposed along the ground-facing surfaces thereof. The rubber strip 74 may be provided with a flare 76 so as to provide an enhanced surface for the wearer to walk on. The rubber strip 74 may also be provided with a tread or textured surface to enhance traction. In addition, depending on the length of the transitional slots 50, the down position 44 of the walking members 24 illustrated in FIG. 5 can be either the position identified by reference numeral 78 which is substantially adjacent to the lower surface of the wheel 12 or a second position identified by the reference numeral 80 which is a position below the lower surface of the wheels 12.

In the position 80, the walking members 24 would support the entire weight of the wearer of the in-line skate boot 10, whereas in the position 78, it is possible that a portion of the weight of the wearer may be borne by the wheels 12, thus reducing the wear-and-tear on the walking members 24 and reducing the weight bearing strength required. It should be noted that in FIG. 3, the weight of the wearer is shared by the wheels 12 and the walking members 24, with the ends of the walking members 24 being formed so as to provide a large ground surface contact area for the walking members 24 and the wheels 12 to provide a stable walking surface for the wearer of the in-line skate illustrated in FIG. 1.

Additionally included in the embodiment shown in FIG. 5 are an optional pair of recesses 81 disposed on the inner wall surfaces of the walking members 24. The recesses 81 receive the respective nuts 18 therein when the walking members 24 are located in the down position 44. In this fashion, the walking members will be positioned in contact with the wheel support plates 14, thus adding to the structural rigidity of the present invention. The spring 54 is sufficiently strong to bias the walking members 24 against the wheel support plates 14. Further, in this position, it may be possible for the flared portion 76 of the rubber strip 74 to contact the wheels 12.

Figure 6:
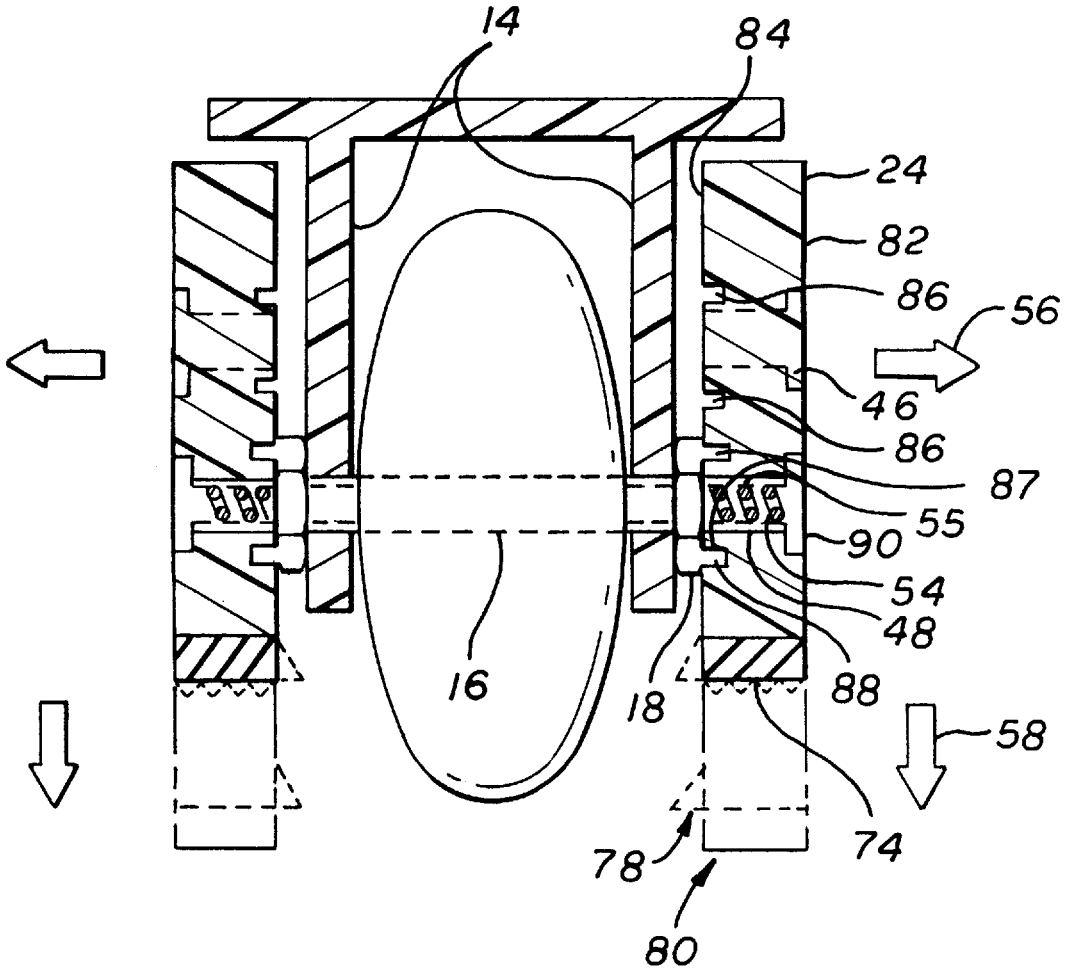
FIG. 6 is a further cross-sectional view taken along the lines 3—3 of FIG. 2 showing still another embodiment of the present invention.

FIG. 6 illustrates another embodiment of the present invention which eliminates the need for the walking member control knobs 32. Specifically, the walking members 24 illustrated in FIG. 6 have an outer wall surface 82 and an inner wall surface 84. The inner wall surface 84 of the walking members 24 are provided with a pair of upper locking pin receptacles 86 and a pair lower locking pin receptacles 87. The locking pin receptacles 86, 87 are provided to receive a corresponding pair of locking pins 88 which are disposed on the nuts 18 which is used to secure the bolts 16 to the wheel support plates 14. In this embodiment, a spring biased flat top 90 is provided for the bolt 16. A biasing force is provided by the spring 54 disposed in the spring channel 55 in fashion substantially similar to that seen in FIG. 3. In this embodiment, the flat top 90 of the bolt 16 allows the entire walking member 24 to be moved in the direction of the outward directional arrow 56. The walking member 24 is moved in the direction of the outward directional arrow 56 a sufficient distance to disengage the locking pins 88 from the locking pin receptacles 86 or 87. The walking member 24 is them moved so that the flat top 90 of the bolt 16 is slid along a channel formed in outer wall surface 82 of the walking member 24 from the lower bolt rest position 48 to the upper bolt rest position 46. Once the flat top 90 of the bolt 16 is positioned in the desired bolt rest position, 46 or 48, the wearer simply allows the biasing force of the spring 92 to pull the walking member 24 in a direction opposite to the outward directional arrow 56 thus causing the locking pins 88 to engage in the upper or lower locking pin receptacles 86, 87.

This embodiment eliminates the need for a connecting rod 36 between the walking member control knobs 32, thus eliminating the need for the wearer to operate a plurality of control knobs 32. This embodiment also contributes to the aerodynamic qualities of the in-line skates, incorporating the present invention. The wearer simply has to grasp a walking member 24, pull the walking member 24 in the direction of the outward directional arrow 56 and slide the walking member 24 to the desired up or down position, 42, 44. As with the embodiment seen in FIG. 5, depending upon the length of the transitional slot 50, the walking member 24 may be positioned in either of two down positions 78, 80.

While the above-discussed features of the present invention represent preferred embodiments of the present invention, it should be understood that the present invention is in no way limited to the features above described. For example, numerous modifications, additions and substitutions can be made to the above-described preferred embodiments of the present invention without departing from the spirit and scope of the present invention.

Specifically, numerous locking devices can be substituted for the devices illustrated in the FIGUREs to hold the bolt 16 in the upper or down position. Similarly, while the preferred embodiments illustrate nuts and spacers in association with the bolts which hold the wheels 12 in place on the skate 10, one skilled in the art would readily recognize that an integral bolting assembly could be formed which serves several functions, thus eliminating a need for separate parts. While the preferred embodiment utilizes injection molded plastic for the walking members described above, one skilled in the art would readily recognize that light weight aluminum, ceramic, polyvinylchloride (PVC), and other suitable materials could be substituted for the plastic of the present invention.

Similarly, while the preferred embodiments illustrate a pair of curved and straight walking members, one skilled in the art would readily recognize that it would be possible to incorporate different shapes for the walking members, or different combinations. For example, one curved and one straight walking member could be utilized, thus providing a stable walking platform while securing the wheels through the agency of the rubber strip disposed along the ground-facing edge of the curved walking member. Similarly, as FIG. 4 illustrates, a spring biasing force on the head of the bolt 16 is not necessarily required in order for the device of the present invention to operate. Further it is possible to utilize slots 30 having any desired shape including vertical. The present invention is not limited to the shape of the slots 30 shown in the drawings.

Through the above preferred embodiments, an in-line skate may be provided with a pair of walking members to allow the wearer thereof to walk in a substantially normal fashion while wearing the in-line skates, without fear of falling due to the rolling of the wheels. In addition to being manufactured for use with original equipment manufacture in-line skates, the present invention can easily be provided as an add-on device for existing in-line skates by replacing the current bolts holding the wheels to the wheel support plates and replacing them with the bolts sufficient to support the walking members illustrated in the FIGUREs above discussed. Lastly, while the bolts 16 in the figures appear to be of substantial length, one skilled in the art will readily recognize that the bolts 16 need only be of sufficient length to support the walking members thereon.

While the above discussion illustrates that numerous modifications, additions and substitutions can be made to the present invention without departing from the spirit and scope thereof, the present invention is best defined by the claims which appear below:

I claim:

1. An in-line skate conversion apparatus for converting an in-line skate having an upper, a plurality of wheels and a wheel support member attached to said upper and adapted to support said plurality of wheels at a predetermined position below said upper such that said plurality of wheels freely rotate at said predetermined position, the apparatus comprising:

a plurality of bolt members for attachment to said wheel support member;

at least one walking member having a corresponding plurality of slots formed therein for receiving and slidably engaging the plurality of bolt members; and means for securing the plurality of bolt members at selected positions in said plurality of slots, wherein the plurality of bolt members are securable at a first position in said plurality of slots such that the walking member extends below a predetermined portion of the plurality of wheels, and at a second position where the walking member is raised relative to the first position;

wherein the walking member secured at said first position in said plurality of slots provides a stable platform to allow a skater to walk in a normal fashion.

2. The in-line skate conversion apparatus according to claim 1, further comprising a second walking member having a corresponding plurality of slots formed therein for receiving the plurality of bolt members.

3. The in-line skate conversion apparatus according to claim 1, wherein at the first position a lower surface of the at least one walking member is disposed substantially parallel to a lower surface of said, plurality of wheels.

4. The in-line skate conversion apparatus according to claim 1, wherein at the first position a lower surface of the at least one walking member is disposed below a lower surface of the plurality of wheels.

5. The in-line skate conversion apparatus according to claim 1, wherein said at least one walking member is arcuately shaped.

6. The in-line skate conversion apparatus according to claim 2, wherein at least one of said walking members is arcuately shaped.

7. The in-line skate conversion apparatus according to claim 1, further including means for moving said at least one walking member inward relative to said wheel support member when said plurality of bolts are slidably moved in said plurality of slots from said second position to said first position.

8. The in-line skate conversion apparatus according to claim 2, further including means for moving at least one of said walking members inward relative to said wheel support member when said plurality of bolts are slidably moved in said plurality of slots from said second position to said first position.

9. The in-line skate conversion apparatus according to claim 1, wherein said at least one walking member has a tread on a lower surface thereof.

10. The in-line skate conversion apparatus according to claim 2, wherein at least one of said plurality of walking members has a tread formed on a lower surface thereof.

11. The in-line skate conversion apparatus according to claim 2, wherein at the first position a lower surface of the walking members is disposed substantially parallel to a lower surface of said plurality of wheels.

12. The in-line skate conversion apparatus according to claim 2, wherein at the first position a lower surface of the walking members is disposed below a lower surface of the plurality of wheels.

13. An in-line skate conversion apparatus for converting an in-line skate having an upper, a plurality of wheels and a wheel support member attached to said upper and adapted to support said plurality of wheels at a predetermined position below said upper such that said plurality of wheels freely rotate at said predetermined position, the apparatus comprising:

a plurality of bolt members for attachment to said wheel support member;

at least one arcuately shaped walking member having a corresponding plurality of slots formed therein for receiving and slidably engaging the plurality of bolt members; and means for securing the plurality of bolts at selected positions in said plurality of slots, wherein the plurality of bolt members are securable at a first position in said plurality of slots such that the walking member extends below a predetermined portion of the plurality of wheels, and at a second position where the walking member is raised relative to the first position;

wherein the plurality of slots are formed along the arcuately shaped portion of the at least one arcuately shaped walking member, a lower surface of the walking member being adapted to contact and inhibit movement of said plurality of wheels when said plurality of bolts are secured in said first position.

14. An in-line skate conversion apparatus for converting an in-line skate having an upper, a plurality of wheels and a wheel support member attached to said upper and adapted to support said plurality of wheels at a predetermined position below said upper such that said plurality of wheels freely rotate at said predetermined position, the apparatus comprising:

a plurality of bolt members for attachment to said wheel support member;

at least one arcuately shaped walking member and a second walking member, each walking member having a corresponding plurality of slots formed therein for receiving and slidably engaging the plurality of bolt members; and means for securing the plurality of bolts at selected positions in said plurality of slots, wherein the plurality of bolt members are securable at a first position in said plurality of slots such that the walking members extends below a predetermined portion of the plurality of wheels, and at a second position where the walking members are raised relative to the first position;

wherein the plurality of slots are formed along the arcuately shaped portion of the at least one arcuately shaped walking member, a lower surface of the arcuately shaped member being adapted to contact and inhibit movement of said plurality of wheels in said first position.

15. An in-line skate conversion apparatus for converting an in-line skate having an upper, a plurality of wheels and a wheel support member attached to said upper and adapted to support said plurality of wheels at a predetermined position below said upper such that said plurality of wheels freely rotate at said predetermined position, the apparatus comprising:

a plurality of bolt members for attachment to said wheel support member;

at least one arcuately shaped walking member having a corresponding plurality of slots formed therein for receiving and slidably engaging the plurality of bolt members; and means for securing the plurality of bolts at selected positions in said plurality of slots, wherein the plurality of bolt members are securable at a first position in said plurality of slots such that the walking member extends below a predetermined portion of the plurality of wheels, and at a second position where the walking member is raised relative to the first position;

wherein said at least one arcuately shaped walking member has a rubber surface adapted to contact with at least one of said plurality of wheels and the ground, the walking member secured at said first position in said plurality of slots thereby providing a stable platform to allow a skater to walk in a normal fashion.

16. An in-line skate conversion apparatus for converting an in-line skate having an upper, a plurality of wheels and a wheel support member attached to said upper and adapted to support said plurality of wheels at a predetermined position below said upper such that said plurality of wheels freely rotate at said predetermined position, the apparatus comprising:

a plurality of bolt members for attachment to said wheel support member;

at least one arcuately shaped walking member and a second walking member, each walking member having a corresponding plurality of slots formed therein for receiving and slidably engaging the plurality of bolt members; and means for securing the plurality of bolts at selected positions in said plurality of slots, wherein the plurality of bolt members are securable at a first position in said plurality of slots such that the walking members extends below a predetermined portion of the plurality of wheels, and at a second position where the walking members are raised relative to the first position;

wherein said at least one said arcuately shaped walking member has a rubber surface adapted to contact with at least one of said plurality of wheels and the ground, the walking member secured at said first position in said plurality of slots thereby providing a stable platform to allow a skater to walk in a normal fashion.

17. An in-line skate conversion apparatus for converting an in-line skate having an upper, a plurality of wheels and a wheel support member attached to said upper and adapted to support said plurality of wheels at a predetermined position below said upper such that said plurality of wheels freely rotate at said predetermined position, the apparatus comprising:

a plurality of bolt members for attachment to said wheel support member;

at least one walking member having a corresponding plurality of slots formed therein for receiving and slidably engaging the plurality of bolt members; and means for securing the plurality of bolt members at selected positions in said plurality of slots, wherein the plurality of bolt members are securable at a first position in said plurality of slots such that the walking member extends below a predetermined portion of the plurality of wheels, and at a second position where the walking member is raised relative to the first position;

wherein said means for securing comprises at least one pin and a receptacle provided in said at least one walking member for receiving the pin.

18. An in-line skate conversion apparatus for converting an in-line skate having an upper, a plurality of wheels and a wheel support member attached to said upper and adapted to support said plurality of wheels at a predetermined position below said upper such that said plurality of wheels freely rotate at said predetermined position, the apparatus comprising:

a plurality of bolt members for attachment to said wheel support member;

a first and second walking member each having a corresponding plurality of slots formed therein for receiving and slidably engaging the plurality of bolt members; and means for securing the plurality of bolt members at selected positions in said plurality of slots, wherein the plurality of bolt members are securable at a first position in said plurality of slots such that the first and second walking members extend below a predetermined portion of the plurality of wheels, and at a second position where the first and second walking members are raised relative to the first position;

wherein said means for securing comprises at least one pin and receptacle provided in said walking members for receiving the pin.

* * * * *